US009130262B2

(12) United States Patent
Park et al.

(10) Patent No.: US 9,130,262 B2
(45) Date of Patent: Sep. 8, 2015

(54) DIRECTION CONTROL ANTENNA AND METHOD OF CONTROLLING THE SAME

(71) Applicant: Electronics and Telecommunications Research Institute, Daejeon (KR)

(72) Inventors: Juderk Park, Daejeon (KR); Nae-soo Kim, Daejeon (KR); Cheol Sig Pyo, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 180 days.

(21) Appl. No.: 13/655,895

(22) Filed: Oct. 19, 2012

(65) Prior Publication Data

US 2013/0342424 A1 Dec. 26, 2013

(30) Foreign Application Priority Data

Jun. 25, 2012 (KR) ..... 10-2012-0068158

(51) Int. Cl.
*H01Q 9/04* (2006.01)
*H01Q 3/24* (2006.01)

(52) U.S. Cl.
CPC ..... *H01Q 9/0442* (2013.01); *H01Q 3/247* (2013.01)

(58) Field of Classification Search
CPC .... H01Q 9/0442; H01Q 3/247; H01Q 9/0407
USPC ..... 343/700 MS, 749, 752
See application file for complete search history.

(56) References Cited

U.S. PATENT DOCUMENTS

| | | | | |
|---|---|---|---|---|
| 6,317,084 | B1 * | 11/2001 | Chen et al. | 343/700 MS |
| 6,677,898 | B2 | 1/2004 | Cheng et al. | |
| 7,002,527 | B2 | 2/2006 | Sugawara | |
| 7,164,387 | B2 * | 1/2007 | Sievenpiper | 343/702 |
| 2008/0198086 | A1 | 8/2008 | Coupez et al. | |
| 2009/0273533 | A1 | 11/2009 | Wolf et al. | |
| 2011/0248898 | A1 * | 10/2011 | Rothwell et al. | 343/731 |

FOREIGN PATENT DOCUMENTS

JP 2004-304785 10/2004

* cited by examiner

*Primary Examiner* — Robert Karacsony
(74) *Attorney, Agent, or Firm* — Nelson Mullins Riley & Scarborough LLP

(57) ABSTRACT

In a direction control antenna, a plurality of impedance elements are connected between a ground body and a radiator, a plurality of switches are connected between each impedance element and the ground body, and on/off of a plurality of switches is controlled according to a control instruction from the outside. In this case, by the turned-on switch, a radiation direction and a radiation form are determined according to short circuit positions of the radiator that is short-circuited to the ground body and the number of short circuit positions.

7 Claims, 10 Drawing Sheets

<Prior Art>

Short-circuit of first and second short circuit pins

Short-circuit of second and third short circuit pins

Short-circuit of third and fourth short circuit pins

Short-circuit of first and fourth short circuit pins

Short-circuit of first and third short circuit pins or second and fourth short circuit pins

DIRECTION CONTROL ANTENNA AND METHOD OF CONTROLLING THE SAME

CROSS-REFERENCE TO RELATED APPLICATION

This application claims priority to and the benefit of Korean Patent Application No. 10-2012-0068158 filed in the Korean Intellectual Property Office on Jun. 25, 2012, the entire contents of which are incorporated herein by reference.

BACKGROUND OF THE INVENTION (a) Field of the Invention

The present invention relates to a direction control antenna and a method of controlling the same. More particularly, the present invention relates to a small direction control antenna that can be mounted in a small output wireless transmission apparatus and a method of controlling the same.

(b) Description of the Related Art

In general, in a communication system using a small output wireless transmission apparatus, a terminal, a communication node, and a wireless repeater have a single radio frequency (RF) port and operate with low power. Therefore, a direction control antenna that is used for the wireless transmission apparatus has a small size and has low power consumption for direction control.

FIG. 1 is a perspective view illustrating a direction control antenna having a conventional single RF port.

As shown in FIG. 1, the direction control antenna includes a radiator 20 that is mounted at the center of a ground body 10, and a plurality of parasitic elements 30 that are arranged in a circular shape on the ground body 10 at a periphery of the radiator 20. In this case, a gap d1 between the parasitic element 30 and the parasitic element 30 and a gap d2 between the radiator 20 and the parasitic element 30 are designed to be about ¼ of a wavelength of a frequency using in the direction control antenna, and a radius of the ground body 10 is designed to be about ½ of the wavelength. In such a direction control antenna, at a lower end of each parasitic element 30, a predetermined capacity of an impedance element such as a capacitor is connected to the ground body 10 through a switch, on/off of each switch is determined according to the control of a controller, and a direction is determined and radiation is performed according to a combination of the parasitic elements 30 that are connected to the turn-on switch.

In a small output wireless transmission apparatus, for direction control, when forming a direction control antenna having a small single RF port, if the parasitic element 30 is used, in order to minimize interference between the parasitic elements 30 and between the radiator 20 and the parasitic element 30, it is necessary to form a predetermined gap between the parasitic elements 30 and between the radiator 20 and the parasitic element 30. Further, in order to form a radiation direction along a horizontal plane, a separation distance is necessary between the parasitic element and a boundary of the ground surface. Therefore, the size of the direction control antenna increases. In general, the size of the direction control antenna becomes about one wavelength of a frequency in which a diameter of a ground body uses.

Further, in order to perform direction control in all directions, the parasitic element 30 should be disposed in a symmetrical structure about the radiator 20 and is thus appropriate for a configuration of six sectors of a circular disposition structure, and the number of controllable sectors is limited.

SUMMARY OF THE INVENTION

The present invention has been made in an effort to provide a direction control antenna and a method of controlling the same having advantages of solving problems of the limited number of sectors and an antenna size generated when forming a direction control antenna having a single RF port using a parasitic element.

An exemplary embodiment of the present invention provides a direction control antenna. The direction control antenna includes a ground body, a plurality of impedance elements, a plurality of switches, and a controller. The radiator radiates a radio frequency (RF) signal and is used as a direction control element of the direction control antenna. The plurality of impedance elements are connected between the radiator and the ground body. The plurality of switches are connected between each impedance element and the ground body. The controller controls on/off of the plurality of switches according to a control instruction from the outside. A radiation direction and a radiation form are determined according to a short circuit position of the radiator that is short-circuited to the ground body and the number of the short circuit positions by the turned-on switch.

The radiator may be one flat radiator.

A shape of the radiator may have symmetry.

A stub may be formed at an edge of the radiator.

The direction control antenna may further include a plurality of short circuit pins that are each connected between the radiator and the plurality of impedance elements.

The plurality of short circuit pins may be symmetrically disposed.

The controller may control on/off of the plurality of switches to constantly maintain the number of short circuit points.

The direction control antenna may further include: an RF power supply element that supplies an RF signal and that is connected to the ground body; and a power supply line that transfers the RF signal from the RF power supply element to the radiator.

Another embodiment of the present invention provides a method of controlling a direction control antenna. The direction control antenna includes: a radiator; a plurality of switches that are connected between the radiator and a ground body; and a plurality of impedance elements that are connected between each switch and the radiator. The method includes determining a short circuit position of the radiator that is short-circuited to the ground body according to a control instruction from the outside, and turning on a switch corresponding to the short circuit position among a plurality of switches that are connected between the ground body and the radiator.

The turning on of a switch may include radiating an RF signal according to a radiation direction and a radiation form according to the short circuit position and the number of short circuit positions.

DETAILED DESCRIPTION OF THE EMBODIMENTS

Figure 1:
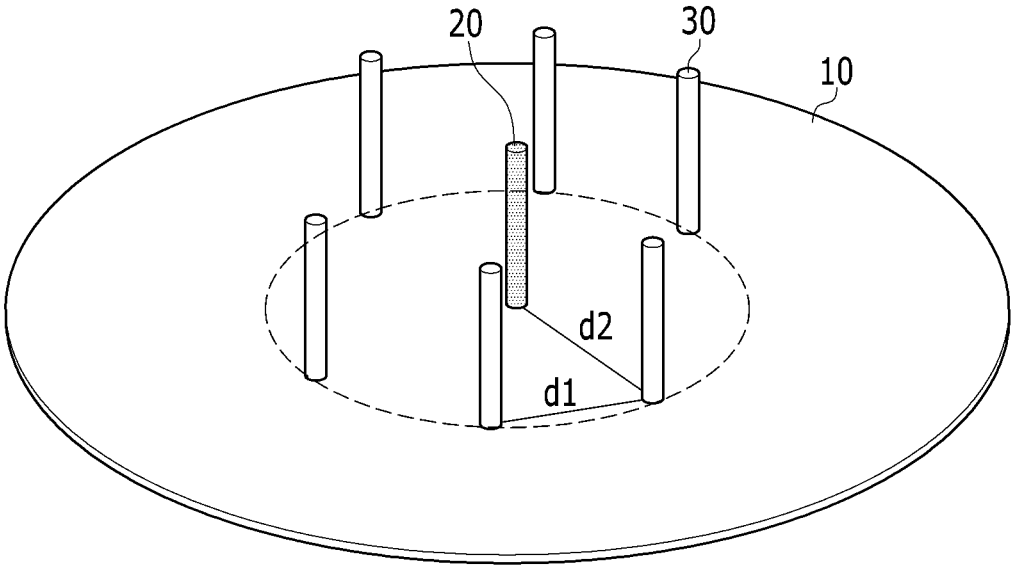
FIG. 1 is a perspective view illustrating a direction control antenna having a conventional single RF port.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

In addition, in the entire specification and claims, unless explicitly described to the contrary, the word "comprise" and variations such as "comprises" or "comprising" will be understood to imply the inclusion of stated elements but not the exclusion of any other elements.

Hereinafter, a direction control antenna and a method of controlling the same according to an exemplary embodiment of the present invention will be described in detail with reference to the drawings.

Figure 2:
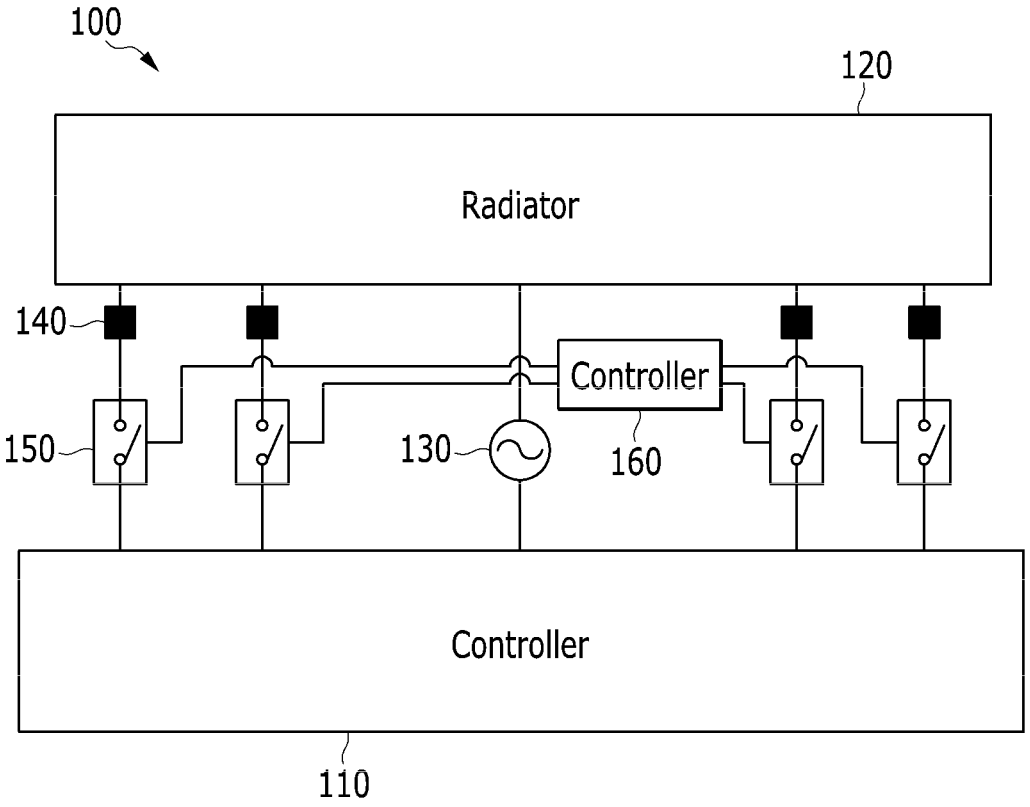
FIG. 2 is a diagram illustrating a direction control antenna according to an exemplary embodiment of the present invention.

FIG. 2 is a diagram illustrating a direction control antenna according to an exemplary embodiment of the present invention.

Referring to FIG. 2, a direction control antenna 100 includes a ground body 110, a radiator 120, an RF power supply unit 130, a plurality of impedance elements 140, a plurality of switches 150, and a controller 160.

When the radiator 120 receives an RF signal from the RF power supply unit 130, the radiator 120 radiates the RF signal. The radiator 120 is one flat radiator and is used as a direction control element. The RF power supply unit 130 transfers an RF signal to the radiator 120.

The plurality of impedance elements 140 determine impedance of the direction control antenna 100. The plurality of impedance elements 140 are each connected between the plurality of switches 150 and the radiator 120. Therefore, when one switch 150 is turned on, the impedance element 140 that is connected to the switch 150 is connected to the ground body 110. Finally, the radiator 120 is short-circuited to the ground body 110 by the turned-on switch 150, and a short circuit position of the radiator 120 is determined.

The plurality of switches 150 are connected between the plurality of impedance elements 140 and the ground body 110, and on/off of the plurality of switches 150 is determined according to a control instruction of the controller 160. In this case, impedance of the direction control antenna 100 is determined according to a combination of impedance elements corresponding to a turned-on switch 150 of the plurality of switches 150. Further, a radiation direction and a radiation form are determined according to a shape and short circuit positions of the radiator 120 and the number of the short circuit positions.

The controller 160 receives a control instruction from the outside, and on/off of the plurality of switches 150 is controlled according to the received control instruction. A user determines a radiation direction and a radiation form, and a switch 150 to turn on among the plurality of switches 150 is determined according to the radiation direction and the radiation form. The control instruction includes information of the switch 150 to turn on.

The direction control antenna 100 may further include a processor (not shown) such as a micro-controller unit (MCU), and the user manipulates a processor and the processor transfers a control instruction according to manipulation to the controller 160.

In this way, because the direction control antenna 100 uses the radiator 120 as a direction control element, a parasitic element is unnecessary. Because the direction control antenna 100 is simply controlled and does not require a parasitic element for direction control, the direction control antenna 100 may be formed in a small size. Further, because the number of controllable sectors is determined according to a shape of the radiator 120, the number of sectors may be variously formed according to the shape of the radiator 120.

Further, because the direction control antenna 100 has a structure that connects a short circuit position of the radiator 120 to the ground body 110 through the impedance element 140, the direction control antenna 100 has a simple structure, simply performs control for a radiation direction and a radiation form, and is easily applied to small equipment.

Four sector direction control antennas that are controllably formed in four directions based on a structure of such a direction control antenna 100 will be described in detail with reference to FIGS. 3 to 9.

Figure 3:
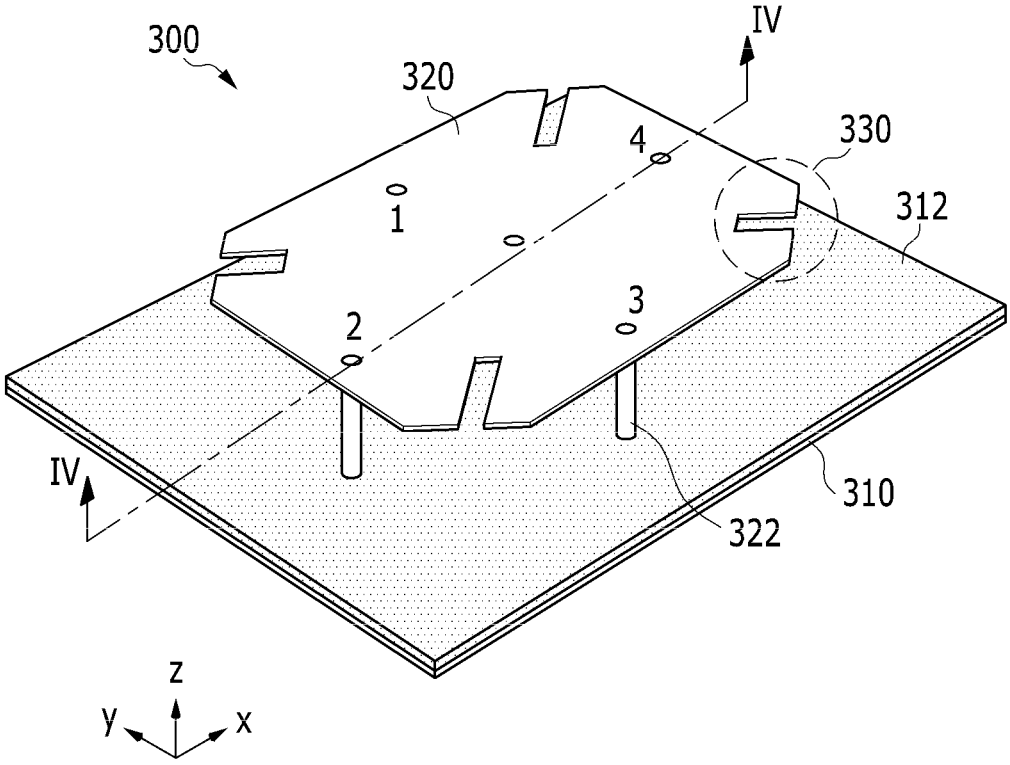
FIG. 3 is a perspective view illustrating an example of a direction control antenna according to an exemplary embodiment of the present invention.
Figure 4:
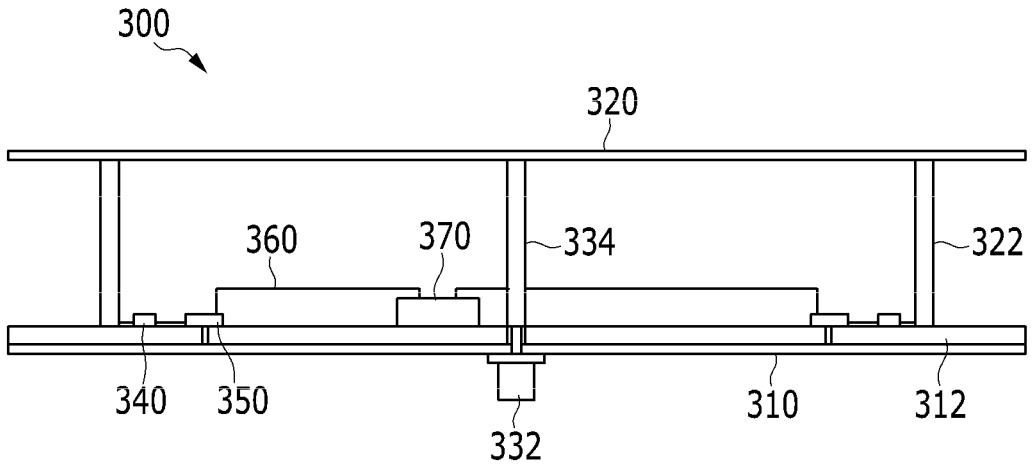
FIG. 4 is a cross-sectional view illustrating the direction control antenna taken along line IV-IV of FIG. 3.

FIG. 3 is a perspective view illustrating an example of a direction control antenna according to an exemplary embodiment of the present invention, and FIG. 4 is a cross-sectional view illustrating the direction control antenna taken along line IV-IV of FIG. 3.

Referring to FIGS. 3 and 4, a direction control antenna 300 includes a ground body 310, a printed circuit board (PCB) 312, a radiator 320, four short-circuit pins 322, an RF power supply unit (not shown), a connection connector 332, a power supply line 334, four impedance elements 340, four switches 350, a controller 360, and a processor 370.

The ground body 310 is formed in a lower portion of the PCB 312.

The radiator 320 may be formed in one flat type, and the shape of the radiator 320 maintains symmetry. Such a radiator 320 is used as a radiation control element, as described above.

Further, the radiator 320 may form a stub 330 at an edge thereof, and a reactance value of impedance of the direction control antenna 300 is controlled through the stub 330 that is formed at an edge of the radiator 320. Therefore, a separate LC element for impedance may not be necessary. A radiation characteristic may be determined according to a reactance value of impedance of the direction control antenna 300.

The radiator 320 and the PCB 312 are connected by four short circuit pins 322.

The four short circuit pins 322 are symmetrically disposed and include a first short circuit pin, a second short circuit pin, a third short circuit pin, and a fourth short circuit pin.

The RF power supply unit is connected to the connection connector 332, and the connection connector 332 and the radiator 320 are connected by the power supply line 334. The connection connector 332 is connected to the ground body 310. An RF signal that is input from the connection connector 332 is transferred to the radiator 320 through the power supply line 334, and the radiator 320 radiates an RF signal.

Each impedance element 340 is connected to each short circuit pin 322 and is formed in an upper part of the PCB 312.

Each switch 350 is connected between each impedance element 340 and the ground body 310 and is formed in an upper part of the PCB 312.

The each switch 350 determines on/off according to the control of the controller 360. In this case, when the switch 350 is turned on, the impedance element 340 and the ground body 310 are short-circuited, and when the switch 350 is turned off, the impedance element 340 and the ground body 310 are opened. That is, when the switch 350 is turned on, a short circuit position of the radiator 320 is determined through the ground body 310, the switch 350, the impedance element 340, and the short circuit pin 322.

The controller 360 controls on/off of the switch 350 according to a control instruction of the processor 370. In this case, when the number of short circuit pins 322 that are short-circuited to the ground body 310 is constantly controlled, a resonant frequency is the same, and a multiple radiation pattern may be represented.

The processor 370 generates a control instruction according to manipulation from a user and transfers the generated control instruction to the controller 360.

In the direction control antenna 300, while the radiator 320 and the ground body 310 are simultaneously short-circuited using the switch 350, a radiation direction and a radiation form are determined. That is, the direction control antenna 300 has a varying characteristic while maintaining a radiation form according to a combination of short circuit positions by four short circuit pins 322, and when short circuit positions are formed in bilateral symmetry, the direction control antenna 300 performs omni-directionally. In this way, because the number of controllable sectors is determined according to a shape of the radiator 320 and the number of short circuit positions by four short circuit pins 322, when the shape of the symmetrical radiator 320 is variously designed, the number of sectors can be variously formed.

FIGS. 5 to 9 are each diagrams illustrating a change of a radiation form of the direction control antenna that is shown in FIG. 3.

Figure 5:
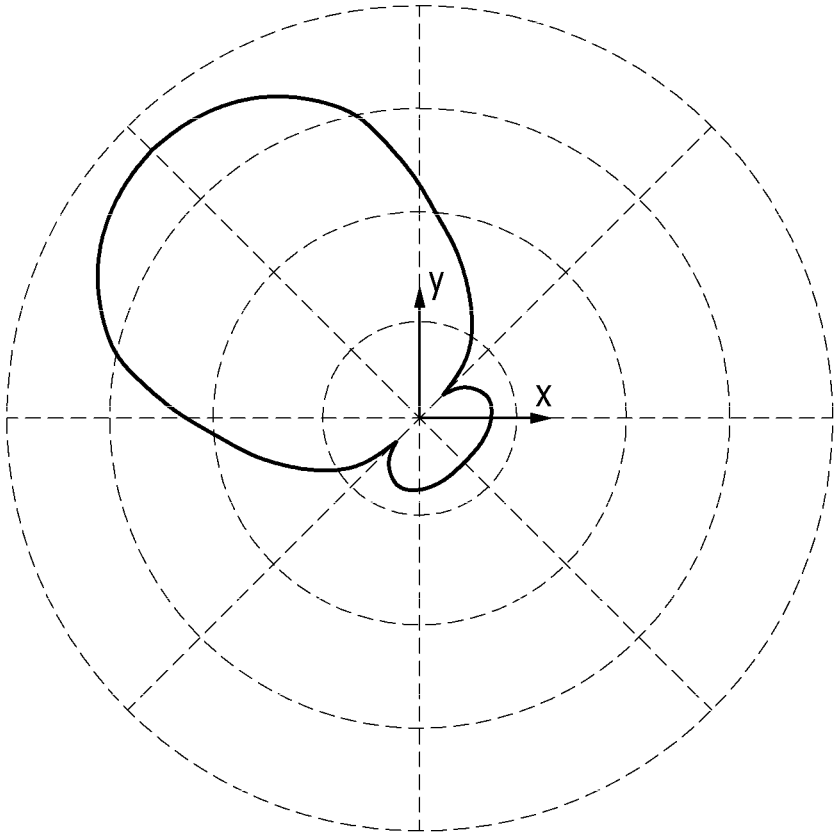
FIGS. 5 to 9 are each diagrams illustrating a change of a radiation position and a radiation form of the direction control antenna that is shown in FIG. 3.
Figure 6:
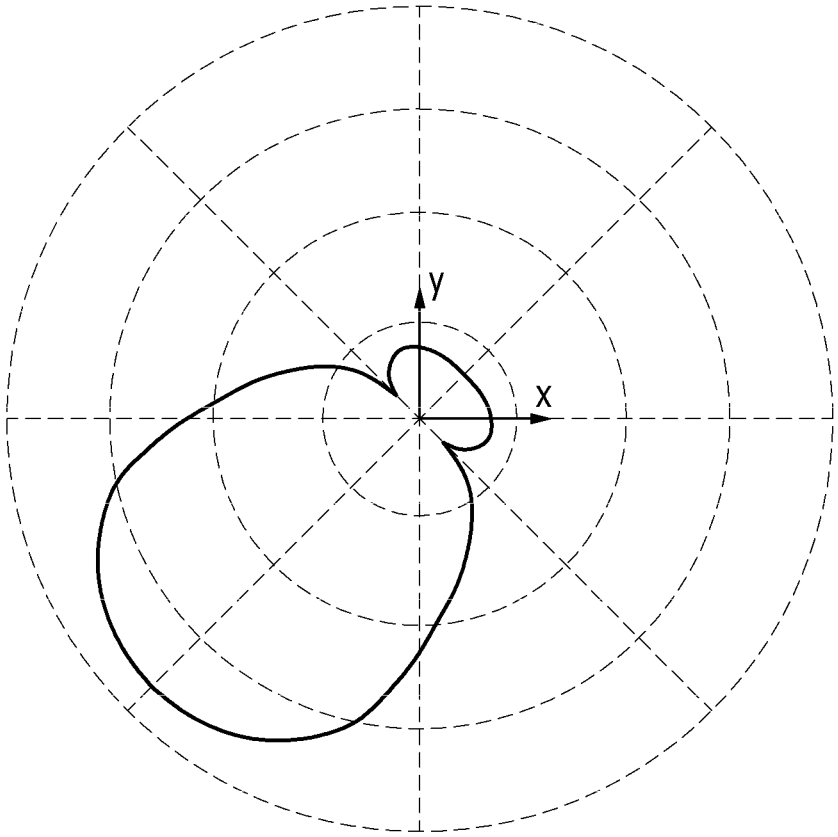
Figure 7:
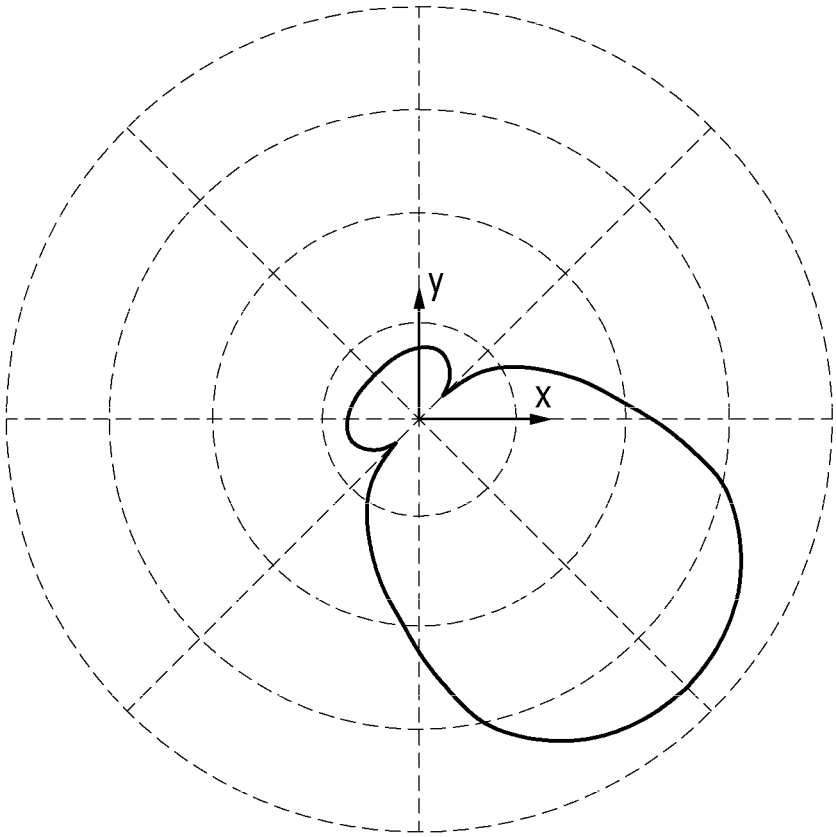
Figure 8:
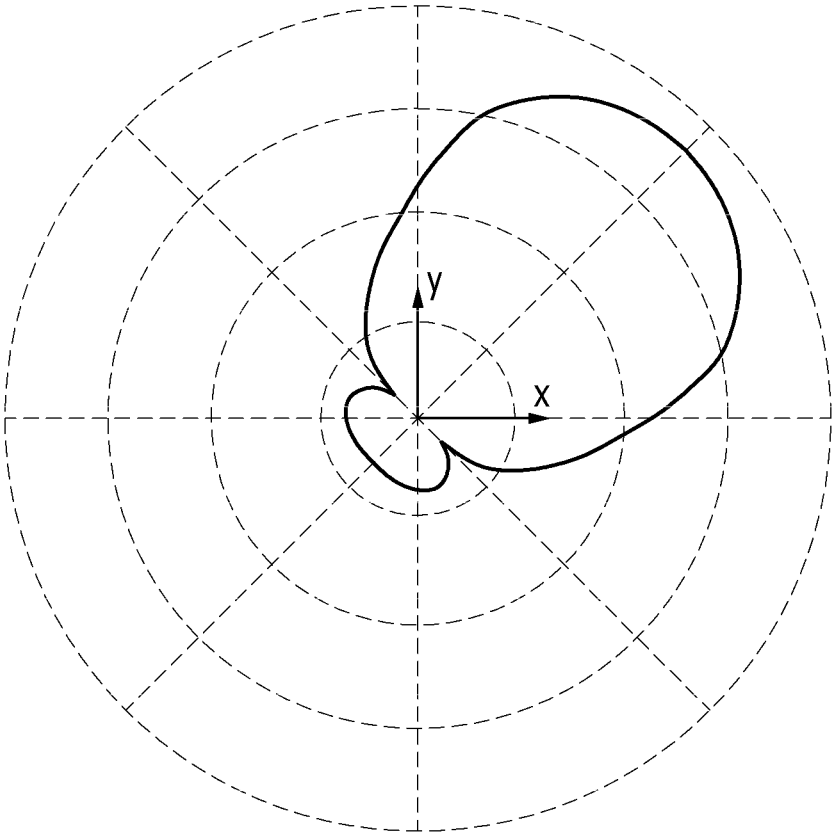
Figure 9:
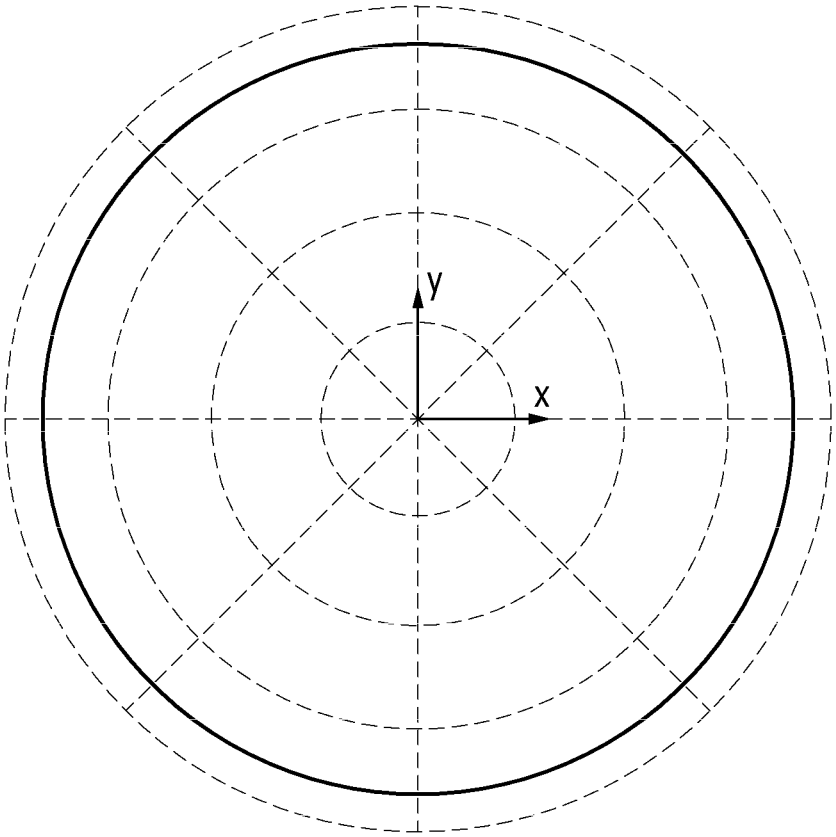

When the first and second short circuit pins of the first, second, third, and fourth short circuit pins are short-circuited to the ground body 310, the direction control antenna 300 represents a radiation direction and a radiation form as shown in FIG. 5. When the second and third short circuit pins are short-circuited to the ground body 310, the direction control antenna 300 represents a radiation direction and a radiation form as shown in FIG. 6, and when the third and fourth short circuit pins are short-circuited to the ground body 310, the direction control antenna 300 represents a radiation direction and a radiation form as shown in FIG. 7. When the first and fourth short circuit pins are short-circuited to the ground body 310, the direction control antenna 300 represents a radiation direction and a radiation form as shown in FIG. 8, and when the first and third short circuit pins or the second and fourth short circuit pins are short-circuited to the ground body 310, the direction control antenna 300 represents a radiation direction and a radiation form as shown in FIG. 9.

In this way, in the direction control antenna 300, a radiation form rotates by 90° according to a combination of short circuit positions by adjacent short circuit pins, and a radiation form represents isotropy by a combination of short circuit positions by opposing short circuit pins. Therefore, when the direction control antenna 300 is omni-directional, while the number of short circuit pins and the number of short circuit positions are maintained, when short circuit positions are symmetrically formed, a frequency change may not occur.

Figure 10:
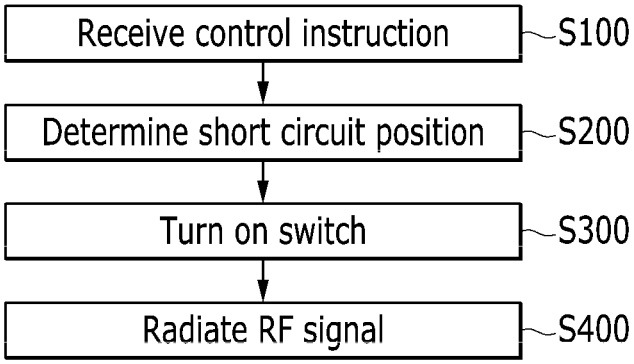
FIG. 10 is a flowchart illustrating a method of controlling a direction control antenna according to an exemplary embodiment of the present invention.

FIG. 10 is a flowchart illustrating a method of controlling a direction control antenna according to an exemplary embodiment of the present invention.

Referring to FIG. 10, the controller 360 of the direction control antenna 300 receives a control instruction from the outside (S100).

The controller 360 determines a short circuit position of the radiator 320 that is short-circuited to the ground body 310 based on the control instruction (S200).

The controller 360 turns on the switch 350 corresponding to the short circuit position (S300). Therefore, the short circuit position of the radiator 320 is short-circuited to the ground body 310. In this case, because the RF power supply unit is connected between the ground body 310 and the radiator 320, the radiator 320 radiates an RF signal, and a radiation direction and a radiation form of the RF signal are determined according to short circuit positions of the radiator 320 and the number of the short circuit positions.

The direction control antenna 300 radiates an RF signal according to the determined radiation direction and radiation form (S400).

The direction control antenna 300 may vary short circuit positions and the number of the short circuit positions through a control instruction, and thus a radiation direction and a radiation form can be easily controlled.

According to an exemplary embodiment of the present invention, because a small direction control antenna that can control a direction and having a structure that is appropriate for a shape and size of various devices can be formed, the direction control antenna can be carried, can be formed in a small size, and can be formed with sectors of a necessary number, and thus can be applied to various wireless equipment. Particularly, the direction control antenna can be applied to a mobile communication terminal, a wireless LAN router, and a communication node of a sensor network.

An exemplary embodiment of the present invention may not only be embodied through the above-described apparatus and/or method but may also be embodied through a program that executes a function corresponding to a configuration of the exemplary embodiment of the present invention or through a recording medium on which the program is recorded, and can be easily embodied by a person of ordinary skill in the art from a description of the foregoing exemplary embodiment.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A direction control antenna comprising:

a ground body;

a radiator that radiates a radio frequency (RF) signal and that is used as a direction control element of the direction control antenna, wherein a stub is formed at an edge of the radiator and a shape of the radiator is symmetrical;

a plurality of impedance elements that are connected between the radiator and the ground body;

a plurality of switches that are connected between each impedance element and the ground body; and a controller that controls on/off of the plurality of switches according to a control instruction from the outside, wherein a radiation direction and a radiation form are determined according to a short circuit position of the radiator that is short-circuited to the ground body and the number of short circuit positions by the turned-on switch, wherein the direction control antenna is capable of beaming radiation omni-directionally.

2. The direction control antenna of claim 1, wherein the radiator is one flat radiator.

3. The direction control antenna of claim 1, further comprising a plurality of short circuit pins that are each connected between the radiator and the plurality of impedance elements.

4. The direction control antenna of claim 3, wherein the plurality of short circuit pins are symmetrically disposed.

5. The direction control antenna of claim 1, wherein the controller controls on/off state of the plurality of switches in order to constantly maintain the number of switches having on state.

6. The direction control antenna of claim 1, further comprising:

an RF power supply element that supplies an RF signal and that is connected to the ground body; and a power supply line that transfers the RF signal from the RF power supply element to the radiator.

7. The direction control antenna of claim 1, wherein the ground body is formed in a lower portion of a printed circuit board (PCB), and the plurality of impedance elements and the plurality of switches are formed in an upper portion of the PCB.

* * * * *